United States Patent [19]

Barnard

[11] Patent Number: 4,617,743

[45] Date of Patent: Oct. 21, 1986

[54] DRYER INSERT, HOLDER, CONTAINER

[76] Inventor: Richard Barnard, 2330 Olive Ave., Fremont, Calif. 94538

[21] Appl. No.: 695,843

[22] Filed: Jan. 28, 1985

[51] Int. Cl.[4] ..... F26B 11/04

[52] U.S. Cl. ..... 34/109; 34/128; 34/133; 68/143; 68/145

[58] Field of Search ..... 34/109, 128, 133; 68/143, 145

[56] References Cited

U.S. PATENT DOCUMENTS

| | | | |
|---|---|---|---|
| 2,298,352 | 10/1942 | Downes | 34/109 |
| 3,316,659 | 5/1967 | Lauck | 34/109 |
| 3,344,532 | 10/1967 | Bigler | 34/133 |
| 3,696,521 | 10/1972 | Hubbard | 34/133 |
| 3,724,095 | 4/1973 | Laue et al. | 34/133 |
| 3,744,402 | 7/1973 | Piegza et al. | 68/143 |
| 4,091,548 | 5/1978 | Daily | 34/133 |
| 4,109,397 | 8/1978 | Daily | 34/133 |
| 4,467,535 | 8/1984 | Hardison | 34/133 |

*Primary Examiner*—Albert J. Makay
*Assistant Examiner*—David W. Westphal

[57] ABSTRACT

An article holding container for a rotary drum dryer comprised of a compartment for holding hosiery, tennis shoes, etc. The compartment is separated into multiple chambers by divider insert means. The compartment is secured inside the drum by an expandable rod with skid resistant means at the ends thereof.

1 Claim, 4 Drawing Figures

DRYER INSERT, HOLDER, CONTAINER

BACKGROUND OF THE INVENTION

The present invention relates to a novel and useful design for a compartment that can be inserted and extracted from a dryer or can be factory installed.

Problems have occured with drying clothes that make the present invention a novel and useful idea such as the noise that occures when tennis shoes are placed in a dryer, tangling of hosiery with other items of clothing, damage to delicate fabrics. The afore mentioned items can be inserted into the Dryer Insert, Holder, Container compartment therefore eliminating the noise of tennis shoes banging against the dryer wall, or if articles of delicate clothing are placed into the compartment damage to the articles can be reduced and tangling of this clothing with other articles can be eliminated. Other items can be contained in the center compartment such as deodorants, fabric freshners, etc.

No attempt has been made to show systems that will perform the functions shown. No prior art shows a device that will separate articles interior to a dryer.

My invention is the only one that shows a multiplicity of dryer tub use by means of a singular or multiple tub dryer insert compartment that can easly be converted to a singular compartment by removal of said divider insert or a multiple compartment by insertion of said divider insert into said center compartment of the Dryer Insert, Holder, Container.

My invention is the only one that allows division of the dryer tub that can use a multiplicity of expandable rod mechanisms holding a center holder, container.

SUMMARY OF THE INVENTION

In accordance with the present invention a novel and useful dryer insert that allows items to be separated from each other interior to a electric or gas dryer is provided.

The electric or gas dryers of today allow tanglement of articles. They allow noise that in most cases can be eliminated with the present invention. Todays dryers may allow some delicate fabrics to be damaged. Some if not all of this damage can be eliminated if the fabrics could be separated from other articles.

It may be apparent that a novel and useful dryer insert not shown in the prior art is provided.

It is therefore an object of the present invention to provide a Dryer Insert, Holder, Container that can be easily inserted or extracted from an electric or gas dryer.

It is another object of the present invention to provide a compartment interior to a dryer that separates articles.

It is yet another object of the invention to provide a compartment or compartments that can hold shoes or other articles that will cause noise if they are not contained.

It is still another object of the invention to provide a compartment that will contain articles that will easly tangle or damage if they are not contained separately.

It can be another object of the invention to show a multiplicity of methods of attachment of the Dryer Insert, Holder, Container's compartment to the interior of the dryer such as expandable rods, screws, bolts, adhesive, and magnets.

Figure 2:
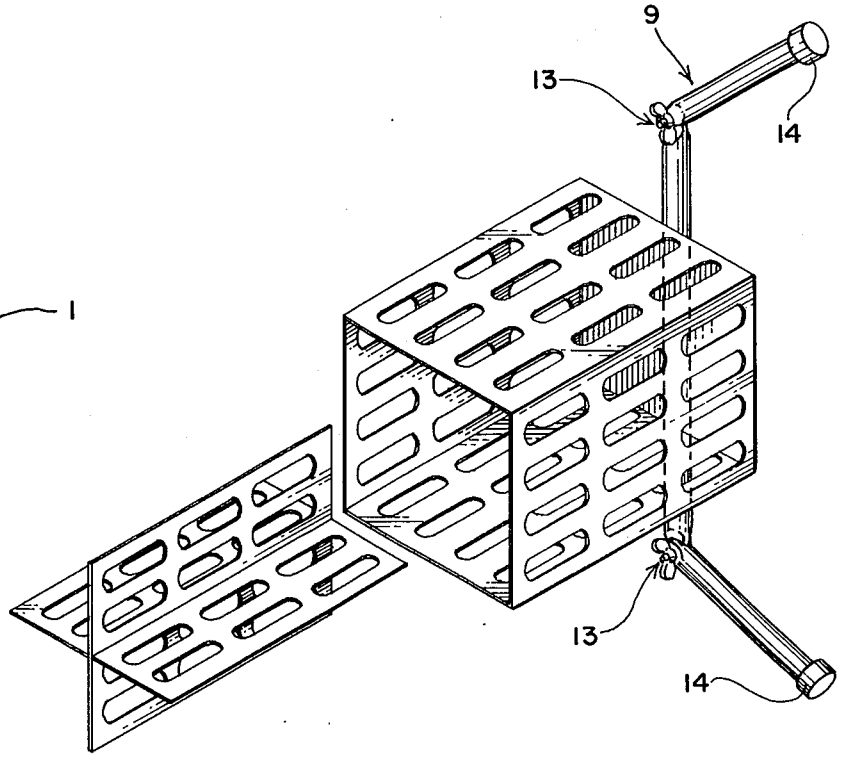
FIG. 2 is a drawing showing rods that are hinged.
Figure 1:
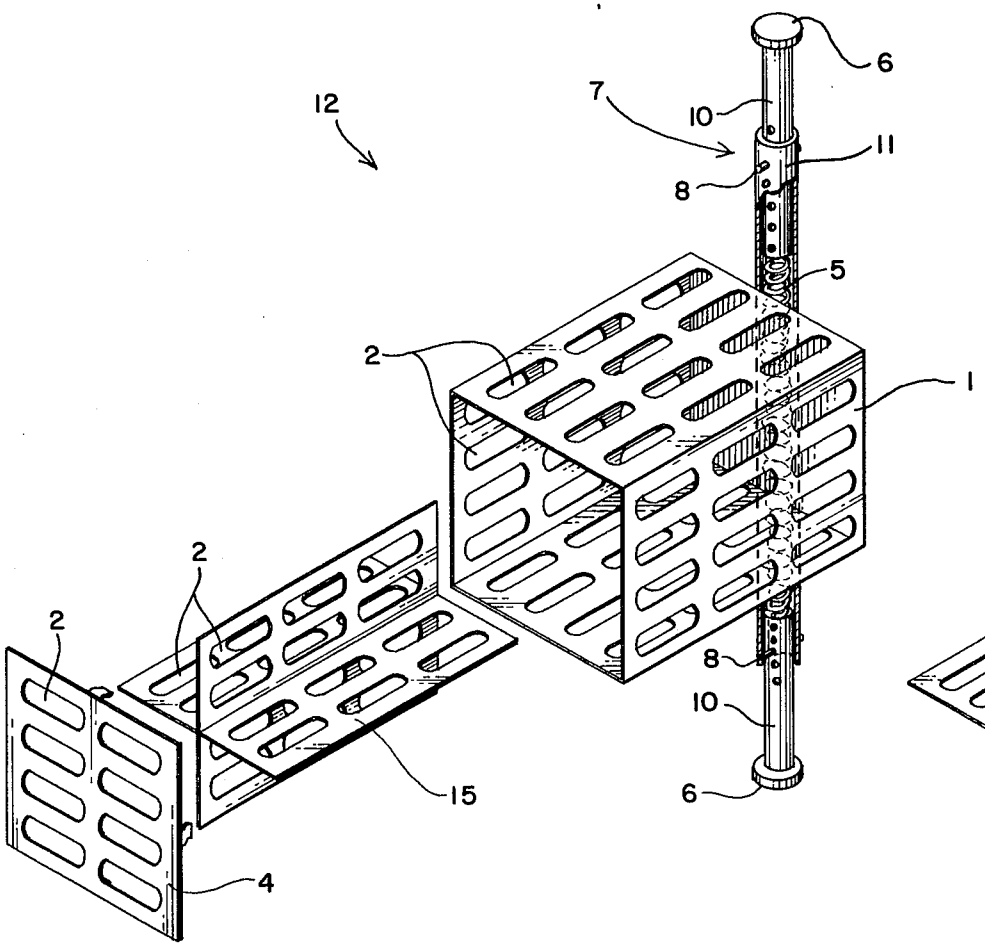
FIG. 1 is a drawing depicting the overall scheme of the present invention.
Figure 4:
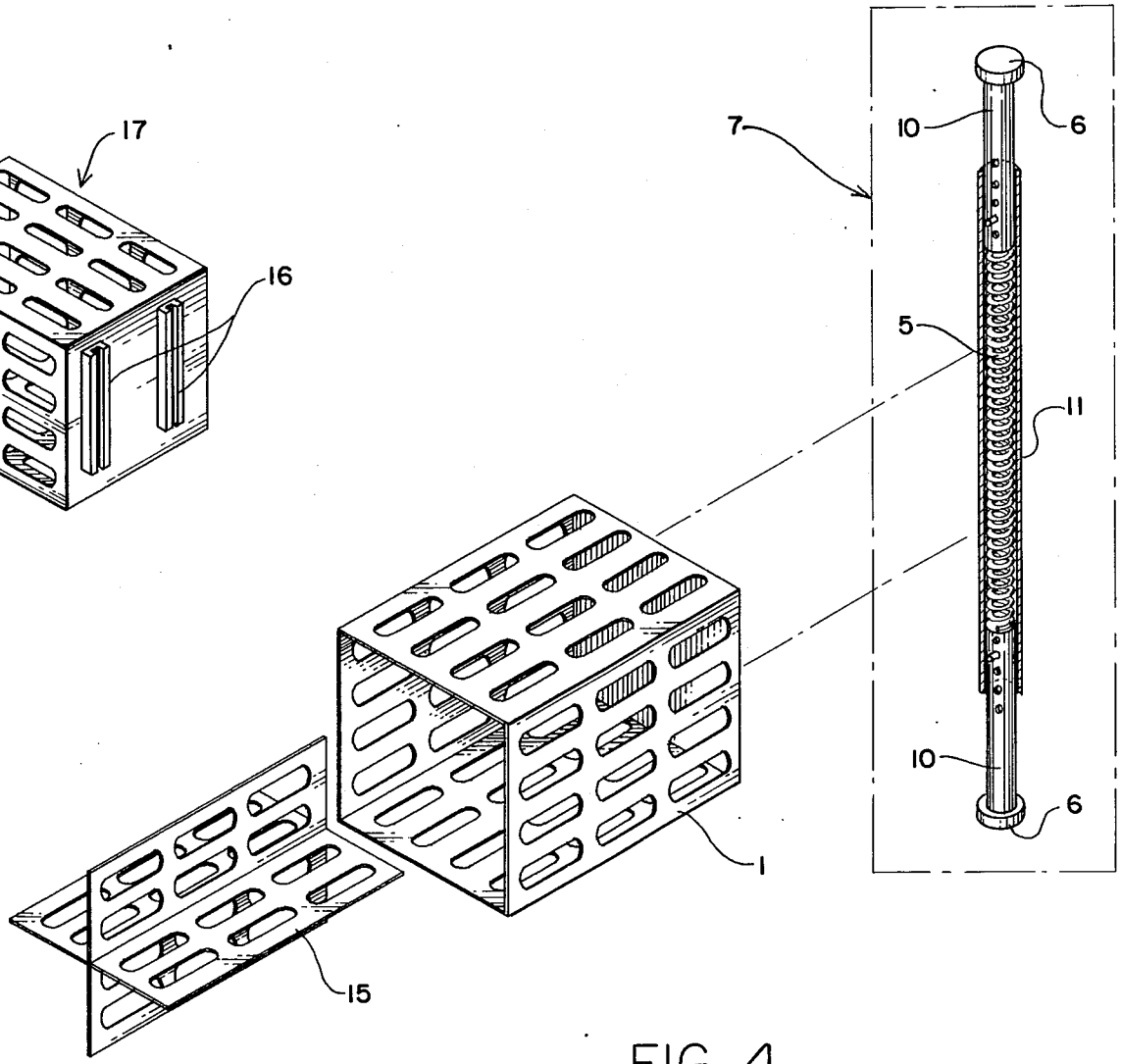
FIG. 4 is a drawing showing the compartment attached to the expandable rod means.
Figure 3:
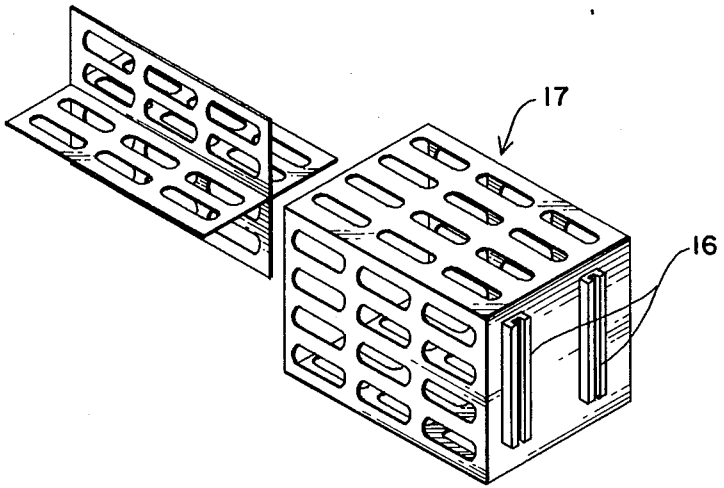
FIG. 3 is a drawing showing compartment use less expandable rods and using magnets for the purpose of securing compartment to interior of dryer.

Various aspects of the present invention will evolve from the following detailed description which should be taken in conjunction with the above delineated drawings.

DESCRIPTION OF THE PREFERRED EMBODIMENTS

The following embodiments of the present invention should be understood and interpreted in accordance with the heretofore described drawings.

The invention as a whole is depected by reference character 12 which would be the complete Dryer Insert, Holder, Container and includes charactors 1-compartment, 2-ventalation holes, 4-door snap on type, 5-spring, 6-skid resistant end, 7-expandable rod, 8-expandable rod locks, 9-collapseable hinged rod, 10-small tube, 11-large tube, 13-locking hinge, 14-skid resistant end. 15-divider insert, 16-magnets.

A expandable rod 7 can be depressed by putting inward pressure on the smaller tube 10 forcing it into the interior of the larger tube 11 containing spring 5. This action will cause spring 5 to depress and store energy that will allow it to force the smaller tube 10 outward when the inward pressure is released. The inward pressure to said small tube 10 could, in most cases, be performed by hand. Said pressure can be accomplished by placing the palm of the hand against the skid resistant end 6 and pushing or skid resistant end 6 could be placed against the dryer's rotatable tub wall while the Dryer Insert, Holder, Container 12 is held by hand and pushed forcing the small tube means 10 to inter the large tube means 11 and depress spring means 5 causing said spring 5 to store energy that will force said smaller tube 10 outward when said pressure is released. When Dryer Insert, Holder, Container 12 is interior to said dryer's rotatable tub and the afore mentioned methods used to depress small tube means 10 into large tube means 11 is performed and said pressure given to small tube means 10 is released spring means 5 with its stored energy caused by said pressure will release and spring means 5 will force the small tube means 10 against said dryer tub wall and skid resistant end 6 will hold said Dryer Insert, Holder, Container 12 in place.

The Dryer Insert, Holder Container 12 is now in place for operation. The locking pin for the expandable rod lock 8 can now be placed through lock holes in large tube means 11 and small tube means 10 to lock both tube means of said expandable rod 7 in place so small tube means 7 won't accidentally slide into large tube means 11 and cause the Dryer Insert, Holder, Container 12 to come loose and tumble interior to said dryer tub. Snap on door 4 can now be taken off compartment means 1 and divider insert 15 can be placed interior to said compartment 1. Articles can now be placed into compartment 1 and door 4 can be placed over said compartment 1 so articles won't fall out. The dryer can now be turned on and the rotation of said dryer tub would cause said Dryer Insert, Holder, Container to rotate. Ventalation holes 2 would allow the heat from said dryer to pass through said compartment means 1 allowing the articles interior to compartment means 1 to dry or if said compartment 1 was holding deodorants or fabric softner they would be allowed to exit by means of said ventalation holes 2 and enter the interior of said dryer.

The divider insert 15 could be removed from compartment means 1 allowing larger items to be placed into said compartment 1.

The entire Dryer Insert, Holder, Container 12 can be metallic, a heat resistant nonmetallic material, a metallic object coated with any heat resistant material or any combination of the above.

Moving to drawing #2. The preferred embodiments would remain the same with the exception of the expandable rod 7 shown on drawing #1. Said rod could be changed to any expandable form such as a collapseable hinged rod 9 shown on drawing #2. Said collapseable hinged rod 9 could be brought upward in a straight lineal position or pressure could be applied to said collapseable hinged rod 9 activating locking hinge 13 and said collapseable hinged rod 9 could be bent at a desired angle. Said collapseable hinged rod 9 would, in most cases, be in the angled position when Dryer Insert, Holder, Container 12 was being placed interior to said dryer tub. Said collapseable hinged rod 9 would then be brought into the straight lineal position for securing said Dryer Insert, Holder, Container 12 to said dryer tub. Skid resistant end 14, similar if not the same as skid resistant end 6 shown on drawing 1, would hold said Dryer Insert, Holder, Container 12 securly to the wall of said dryer tub.

Turning to FIG. #3 compartment 17 can be the same as compartment 1 shown on FIG. #1 with the exception that the expandable rod means 7 and all components 5, 6, 8, 10, and 11 attached to said expandable rod means 7 are removed and magnets 16 shown on FIG. #3 are attached to said compartment 17 so said compartment 17 can be attached to the side or back of the dryer's rotatable tub or the dryer door.

What is claimed:

1. An article holding container for insertion into a rotary drum dryer comprising:

a. compartment means to hold articles of clothing or any other article desired;

b. divider insert means to separate said compartment means into multiple chambers;

c. perforations in said compartment means and said divider means;

d. door, snap on type, for closing said compartment means;

e. expandable rod means to secure said article holding container to interior of said dryer;

f. spring means that will allow said expandable rod means to expand or contract;

g. skid resistant means at end of said expandable rod means that will secure said expandable rod means to interior of said dryer;

h. expandable rod lock means which will lock said expandable rod means in the expanded or contracted position.

* * * * *